US005711414A

United States Patent [19]

Nishitani et al.

[11] Patent Number: 5,711,414

[45] Date of Patent: Jan. 27, 1998

[54] PUSH SWITCH

[75] Inventors: Keizo Nishitani; Daisuke Takanohashi, both of Susono, Japan

[73] Assignee: Yazaki Corporation, Tokyo, Japan

[21] Appl. No.: 659,007

[22] Filed: Jun. 4, 1996

[30] Foreign Application Priority Data

Jun. 7, 1995 [JP] Japan ..... 7-140761

[51] Int. Cl.[6] ..... H01H 13/56

[52] U.S. Cl. ..... 200/524

[58] Field of Search ..... 200/524

[56] References Cited

U.S. PATENT DOCUMENTS

| | | | |
|---|---|---|---|
| 4,382,167 | 5/1983 | Maruyama et al. | 200/524 |
| 4,383,153 | 5/1983 | Kondo et al. | 200/524 |
| 4,449,022 | 5/1984 | Uno et al. | 200/524 |
| 4,531,026 | 7/1985 | Terajima et al. | 200/524 X |
| 5,579,903 | 12/1996 | McEvilly et al. | 200/524 |

FOREIGN PATENT DOCUMENTS

| | | |
|---|---|---|
| 4-8330 | 1/1992 | Japan . |
| 5-75929 | 10/1993 | Japan . |
| 6-13023 | 2/1994 | Japan . |
| 6-43972 | 6/1994 | Japan . |

*Primary Examiner*—Renee S. Luebke

*Attorney, Agent, or Firm*—Oblon, Spivak, McClelland, Maier & Neustadt, P.C.

[57] ABSTRACT

A novel push switch is disclosed, in which a key-top for turning on and off a switch contact by depression has a cam which is adapted to engage a guide pin to lock the key-top. A latch assembly includes the guide pin, a spring plate on which the guide pin is assembled, and a magazine in which the guide pin and the spring plate are assembled. The latch assembly is mounted on a latch mount of the push-switch housing.

3 Claims, 5 Drawing Sheets

PUSH SWITCH

BACKGROUND OF THE INVENTION

1. Field of the Invention

The present invention relates to a push switch, or more in particular to a push switch turned on and off by pushing a key top.

2. Description of the Related Art

A push switch having a similar configuration is disclosed in JP-U Laid-open No. 6-43972. This push switch comprises a switch case, and a guide pin mounted on the inner surface of the switch case with a hexagonal section energized by a spring plate slidable only in a lateral direction toward the center of the switch case. A switch controller energized by a spring is provided longitudinally movable from a backward to a forward direction in the switch case.

A substantially heart-shaped loop-like cam is arranged on the surface of the switch controller opposed to the guide pin. The guide pin, while being fitted in the loop-like cam, is adapted to be circulated in a predetermined direction along the cam by repeating the backwardly push operation of the switch controller to thereby to change over the switch condition.

In the above-mentioned conventional push switch, a lock mechanism including the guide pin, the spring plate and the cam is arranged in the switch case. The resulting problem is that an elaborate work is required for assembling the lock parts in the narrow internal space of the case at the cost of a deteriorated assembly workability.

Also, the parts including the cam, guide pin and spring plate having complicated structures, most of which are exclusive products, can be applied only to a particular type of push switch, and therefore lack the general applicability.

SUMMARY OF THE INVENTION

The present invention has been developed in view of the above-mentioned points, and the object thereof is to provide a general-purpose push switch in which lock parts can be assembled as an independent latch assembly in a housing in one touch and which is applicable to any type of push switches as a latch assembly.

In order to achieve the above-mentioned object, according to the present invention, there is provided a push switch comprising: a latch assembly including a guide pin, a spring plate for energizing the guide pin and a magazine in which the guide pin and the spring plate are incorporated in advance; a housing on which the latch assembly is mounted; and a key-top including a cam and mounted vertically movably on the housing in such a manner as to be locked by the engagement between the guide pin restricted in vertical motion by the housing and the cam, the key-top having a switch contact thereof being turned on and off upon depression thereof.

According to this invention, an independent latch assembly is configured by incorporating the guide pin and the spring plate in the magazine. The assembly work of the small parts including the guide pin and the spring plate at a narrow place in the housing, therefore, is eliminated, with the result that the assembly workability is improved and general-purpose applications of the latch assembly is made possible.

According to another preferred embodiment of the invention, there is provided a push switch comprising a housing including a latch mount on which the latch assembly is mounted and a body member formed in spaced relation with the latch mount, on which the key-top is mounted.

According to this aspect of the invention, the latch assembly is mounted on a latch mount of the housing formed separately from the body member on which the key-top is mounted, thereby further improving the assembly workability.

According to a preferred embodiment of the invention, an engaging protrusion is formed on a selected one of the housing and the magazine, with the other component having an aperture for engaging the protrusion.

According to this embodiment, the latch assembly is fitted in the housing and slid downward thereby to bring the protrusion into engagement with the engaging aperture, while the latch assembly is locked to a latch mount. The latch assembly can thus be mounted in one touch.

According to another preferred embodiment, an engaging slot is formed in a selected one of the key-top and the housing, with an engaging protrusion being formed on the other component, which is adapted to engage the engaging slot and restricts the return movement of the key-top.

According to this aspect of the invention, the engaging protrusion engages the engaging slot by fitting the key-top in the housing and sliding downward, so that the key-top is locked in the housing. The key-top can thus be mounted in one touch.

The nature, principle and utility of the invention will become more apparent from the following detailed description when read in conjunction with the accompanying drawings.

DESCRIPTION OF THE PREFERRED EMBODIMENTS

The present invention will be described below with reference to an embodiment shown in the accompanying drawings.

Figure 1:
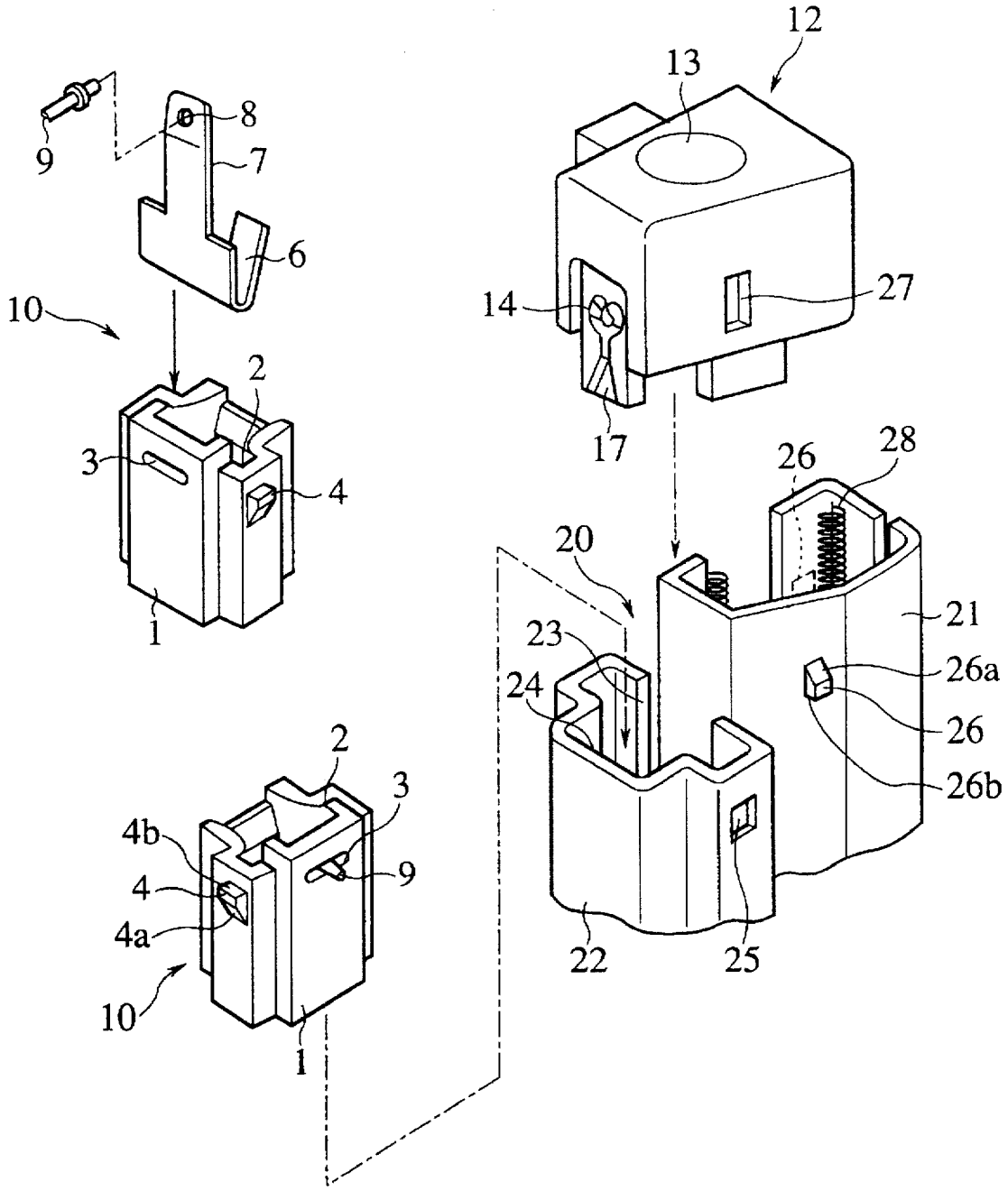
FIG. 1 is an exploded perspective view showing a push switch according to an embodiment of the present invention.
Figure 2:
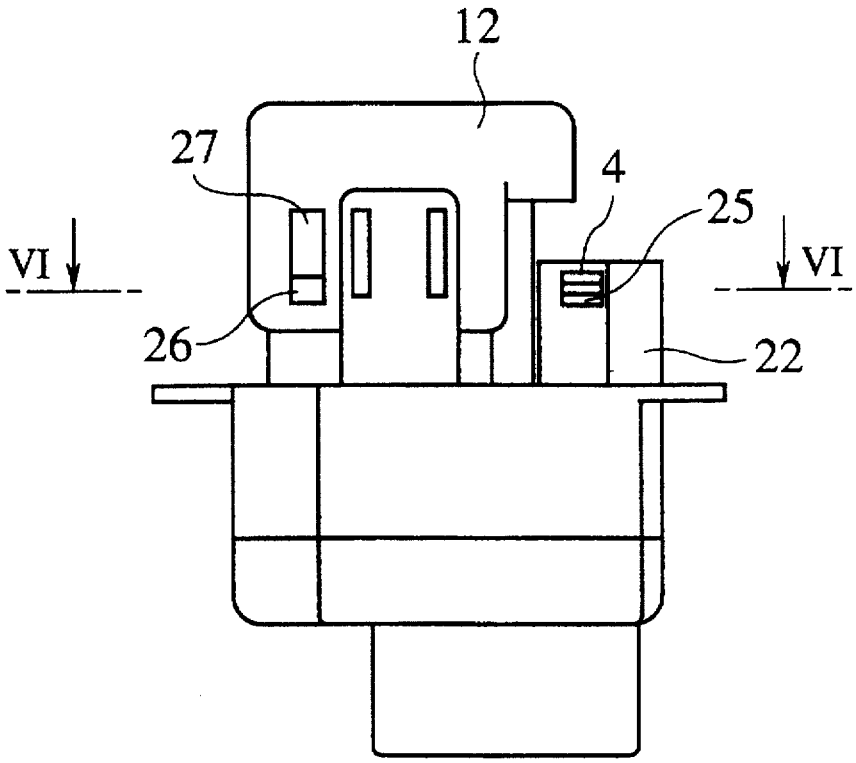
FIG. 2 is a side view showing a push switch according to an embodiment of the invention.
Figure 3:
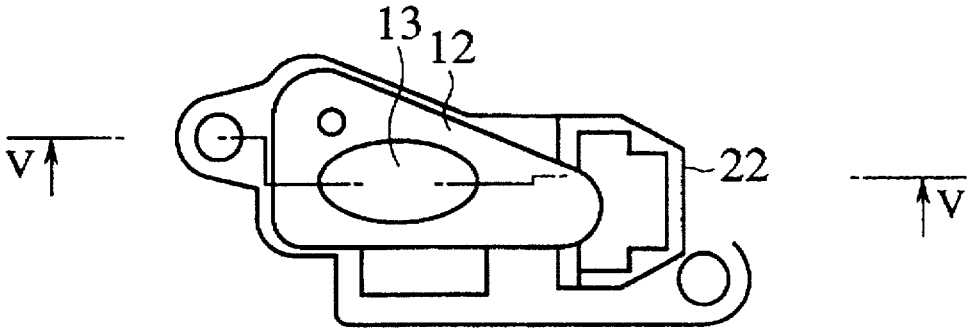
FIG. 3 is a top plan view showing the push switch of FIG. 2.

In FIG. 1, a latch assembly 10 is configured by combination of a magazine 1, a spring plate 7 and a guide pin 9. The magazine 1 formed of plastics or the like has a longitudinal guide groove 2 formed on each side thereof, a laterally-oriented guide slot 3 formed in the front and an engaging protrusion 4 on each of the two sides thereof. The engaging protrusion 4, which has a lower tapered portion **4*a* and an upper square portion 4*b***, has an elasticity specific to a plastic material.

The spring plate 7 with a U-shaped spring 6 formed in the lower portion thereof is inserted into the guide grooves 2 of the magazine 1 with the spring 6 thereof compressed. The guide pin 9 with the base end thereof inserted in the hole 8 formed in the upper end of the spring plate 7 is protruded outward of the magazine 1 from the guide slot 3.

The latch assembly configured this way is incorporated in the housing 20 as shown in FIGS. 2 to 7. The housing 20 includes a body 21 and a latch mount 22 formed separately at the forward end (the extreme left in FIG. 1, and the extreme right in FIG. 2 to 7) of the body 21. The latch mount 22 includes a protruded mounting groove 24 having an opening 23 on the side thereof nearer to the body 21 and an engaging hole 25 formed on each side thereof.

On the other hand, an engaging protrusion 26 is formed on each side of the body 21. The engaging protrusion 26 includes an upper tapered portion 26*a* and a lower square portion 26*b*, and has an elasticity specific to a plastics (FIG. 1).

This latch assembly 10 is fitted in the mounting groove 24 of the latch mount 22 with the guide pin 9 protruded outward from the opening 23 toward the body 21, and locked in the latch mount 22 by engagement between the engaging protrusions 4 and the engaging holes 25.

Figure 4:
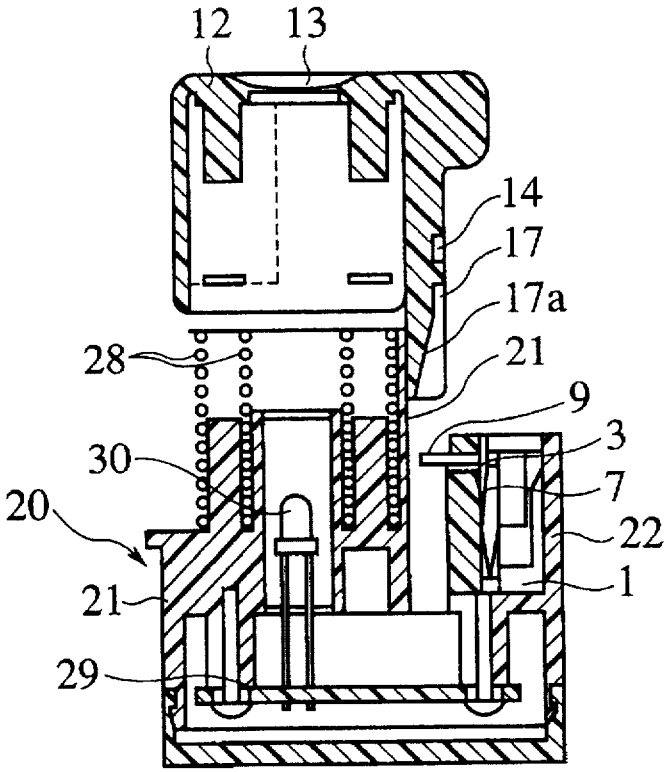
FIG. 4 is a longitudinal side view showing a key-top being assembled according to an embodiment of the invention.
Figure 5:
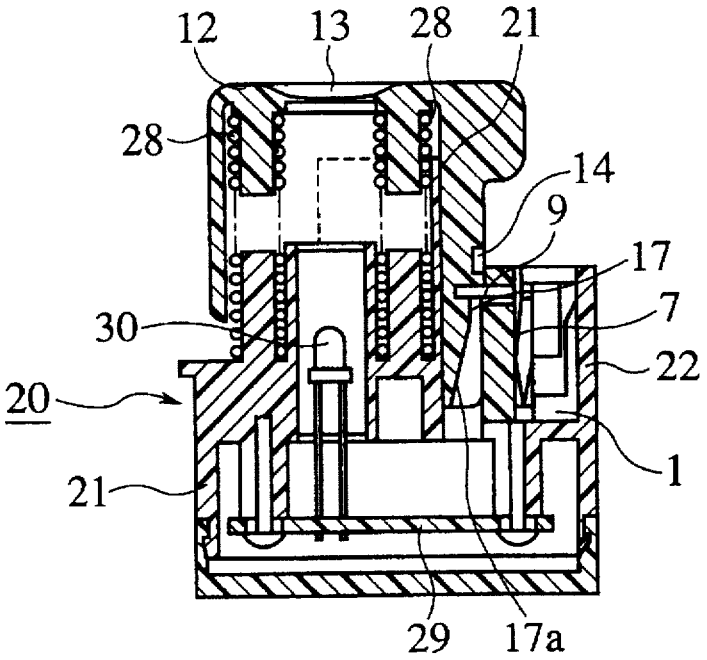
FIG. 5 is a sectional view taken in line V—V in FIG. 3 showing a key-top in a completely assembled state.
Figure 6:
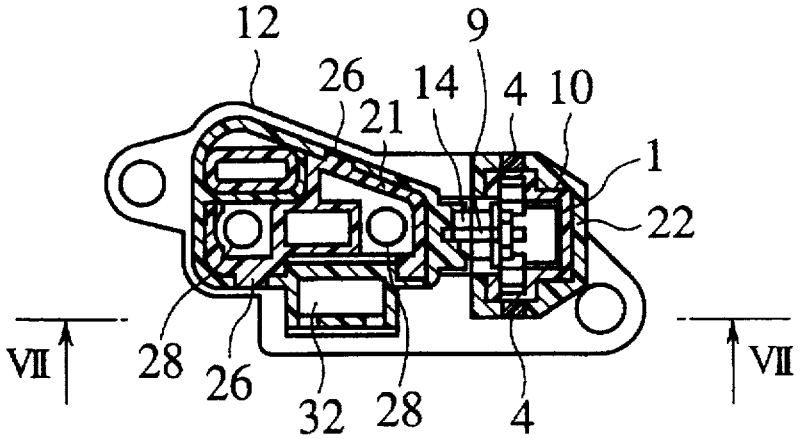
FIG. 6 is a sectional view taken in line VI—VI in FIG. 2.
Figure 7:
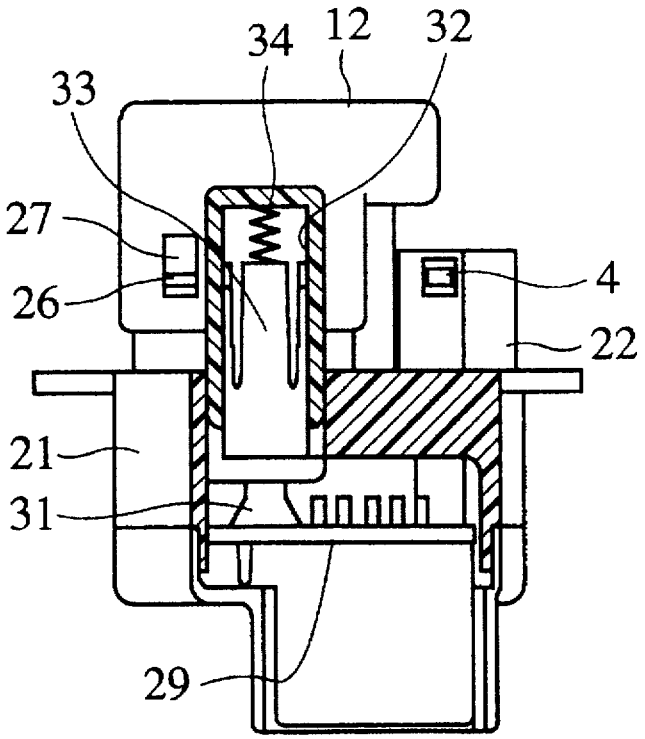
FIG. 7 is a sectional view taken in line VII—VII in FIG. 6.
Figure 8:
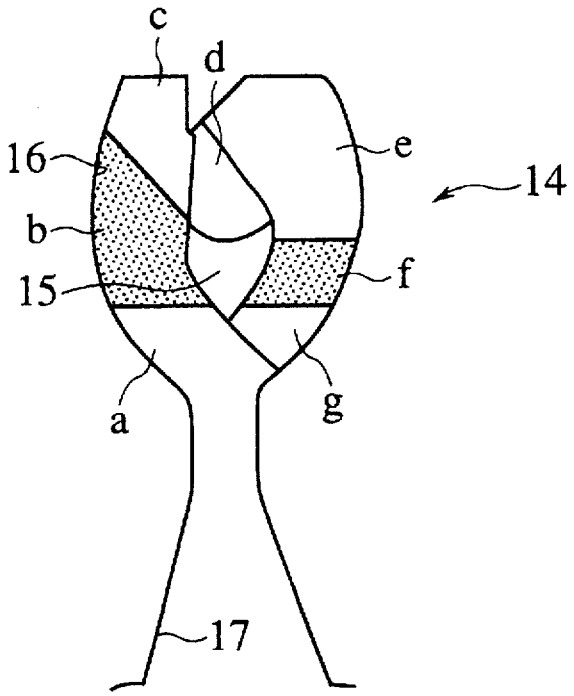
FIG. 8 is a front view showing an example of the cam.

The key-top 12 is shaped as a box open downward and has an illuminated section 13 on the top thereof and a cam 14 formed on the forward end thereof (extreme left in FIG. 1, and extreme right in FIGS. 2 to 7). This cam 14, as shown in FIG. 8, includes a substantially heart-shaped cam block 15 formed at the center and a loop-shaped cam groove 16 formed around the cam block 15. The lower end of the cam groove 16 communicates with a guide groove 17. This guide groove 17 expands in taper downward and includes a tapered bottom surface 17*a* progressively thinned toward the lower end thereof as shown in FIGS. 4 and 5. The key-top 12 has an engaging slot 27 formed in each side thereof.

The key-top 12 formed this way is fitted on the outside of the body 21 of the housing 20 with the cam 14 engaged with an end of the guide pin 9. The key-top 12 is locked by engagement between the engaging slots 27 and the engaging protrusions 26 of the body 21. As a result, the key-top 12 is restricted in upward motion and can be moved only downward.

A coil spring 28, a printed board 29, an LED 30 and a rubber contact seat 31 are mounted in the body 21 of the housing 20. As shown in FIGS. 6 and 7, a slider 33 is inserted in a slide hole 32 formed in the key-top 12. This slider 33 is energized downward by the spring 34 and has a lower end thereof in contact with the rubber contact seat 31. A switch contact (not shown) is arranged in the rubber contact seat 31.

Now, the operation of assembling the push switch will be explained (See FIGS. 1, 4 and 5). A latch assembly 10 is configured by mounting the guide pin 9 and the spring plate 7 on the magazine 1. With the end of the guide pin 9 protruded outward of the opening 23, the magazine 1 of the latch assembly 10 is fitted in the mounting groove 24 of the latch mount 22 and slid downward so that the engaging protrusions 4 engage the engaging holes 25. As a consequence, the latch assembly 10 is assembled on the latch mount 22.

After the component parts including the coil spring 28, the spring 34 and the slider 33 are assembled on the key-top 12, the key-top 12 is fitted on the outside of the housing 20 and slid downward, whereby the engaging protrusions 26 engage the engaging slots 27 and the key-top 12 is locked to the housing 20. In sliding the key-top 12 downward, the guide pin 9 is guided along the guide groove 17 of the cam 14 and locked when reaching the start position G1 (FIG. 9) of the cam 14. This makes it possible to lock the key-top 12 and set the cam 14 in position at the same time. Under this condition, the key-top 12 can be moved downward in the range defined by the engaging slots 27, although its upward movement is restricted by the square portions 26b of the engaging protrusion 26.

As described above, the latch assembly 10 and the key-top 12 can be assembled with a single touch. At the same time, in view of the fact that the guide pin 9 and the spring plate 7 are built in the magazine 1 as an independent latch assembly 10 and this latch assembly 10 is mounted on the latch mount 22 of the housing 20 formed separately from the body 21 on which the key-top 12 is mounted, the need is eliminated of assembling small parts including the guide pin 9 and the spring plate 7 in a small area in the housing 20, thereby improving the assembly workability. Also, since the latch assembly 10 finds wide applications as a part of a lock mechanism, mass production of the latch assembly of the same shape is possible for a lower cost.

Figure 9:
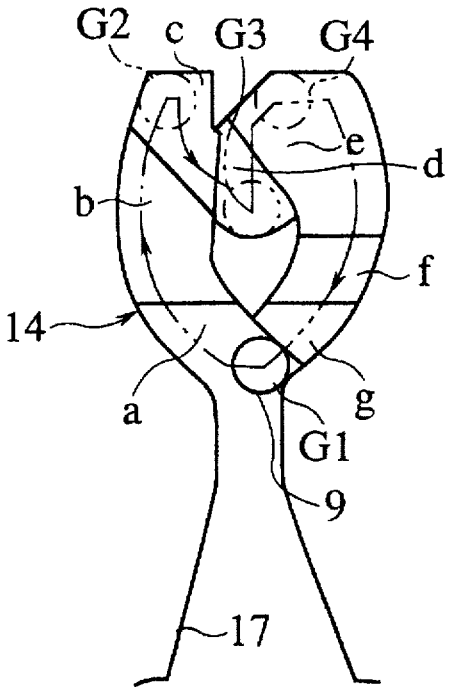
FIG. 9 is a diagram for explaining the operation of a guide pin and a cam in relative positions.

Now, the detail of the cam 14 and the on-off operation of the switch will be explained (FIGS. 8 and 9). FIG. 9 shows relative positions of the cam 14 and the guide pin 9 when the key-top 12 is moved up and down. The dashed arrow indicates the relative motion trace of the guide pin 9 when the key-top 12 moves up and down.

The cam slot 16 has cam surfaces a to g of different depths. As an example, the depths a to g for depth 0 of the cam block 15 are shown as 1.2 (mm) for a, 0.8 for b (dotted), 1.2 for c, 1.6 for d, 1.9 for e, 0.8 for f (dotted), and 0.95 for g. Each boundary a→b, b, b→c, e→f and f→g is assumed to have a natural tilt without any angled corner.

In the initial state of mounting the key-top 12, the guide pin 9 is located at start point G1 as described above. When the key-top 12 is depressed by a finger under this condition, the guide pin 9 reaches the location G2 at the upper end of the cam surface c through the cam surfaces a→b, where the key-top 12 is restricted from further downward motion. With the fall of the key-top 12, the slider 33 also falls, thereby turning on the switch when the guide pin 9 reaches location G2. When the finger is released from the key-top at this position, the key-top 12 rises up under the restitutive power of the coil spring 28. The guide pin 9 moves from cam surface c to cam surface d and reaches location G3 at the upper end of the cam block 15, where the cam block 15 restricts further restoration of the key-top 12. Under this condition, the slider 33 is pressed by the coil spring 34 so that the switch is kept on.

Depressing the key-top 12 under this condition causes the guide pin 7 to reach location G4 at the upper end of the cam surface e from cam surface d, where the key-top 12 is restricted from further fall. When the finger is released from the key-top 12 at this position, the key-top 12 rises up due to the restitutive power of the coil spring 28, and the guide pin 7 returns to start position G1 through the cam surfaces f→g, thereby turning off the switch.

The invention is not confined to the embodiment described above, but includes the following modifications.

Specifically, the latch assembly 10 may be assembled in the body 21 of the housing 20. In such a case, the cam 14 is formed on the inner side surface of the key-top 12 opposed to the guide pin 9 of the latch assembly 10, and the engaging protrusions 4 are formed on a selected one of the body 21 and the magazine 1, with the engaging holes 25 being formed on the other.

The engaging protrusions 4 and the engaging holes 25 may alternatively be formed on the latch mount 22 and the magazine 1 respectively. Also, the engaging slots 27 and the engaging protrusions 26 may be formed on the body 21 of the housing 20 and the key-top 12 respectively.

As described above in detail, according to an embodiment of the invention, an independent latch assembly 10 is configured by building the guide pin 9 and the spring plate 7 in the magazine 1, thereby eliminating the need of the work of assembling small parts including the guide pin 9 and the spring plate 7 in a narrow area in the housing 20. The assembly workability thus is improved, and the resulting wide applicability of the latch assembly 10 makes possible mass production thereof in the same shape, thereby leading to a reduced production cost.

Also, the latch assembly 10, which is fitted in the housing 20 and slid downward until with the engaging protrusions 26 come into mesh with the engaging hole 25*s*, can be mounted in one touch in the latch mount 22. Consequently, the assembly efficiency can be further improved.

In view of the fact that the key-top 12 is fitted in the housing 20 and slid downward so that the engaging protrusions 26 come into engagement with the engaging slots 27, the key-top 12 can be mounted in one touch on the housing 20, leading to a further improvement of the assembly efficiency.

An even further improvement of the assembly efficiency is obtained since the latch assembly 10 is mounted on the latch mount 22 of the housing 20 formed separately from the body 21 on which the key-top 12 is assembled.

What is claimed is:

1. A push switch comprising:

a latch assembly including a guide pin, a spring plate for energizing said guide pin, and a magazine in which said guide pin and said spring plate are disposed;

a housing on which said latch assembly is mounted; said housing assembly comprising a latch mount and a body which is formed separately from said latch mount, said latch assembly being mounted within said latch mount; and a key-top including a cam, said key-top being adapted to be mounted on the body, such that when the key-top is mounted on said body, the cam on said key-top is placed in locking engagement with the guide pin of said latch assembly mounted within said latch mount, wherein said key-top is vertically movable with respect to the body and locked to said latch mount by the engagement between the cam and the guide pin, said key-top being adapted to turn a switch contact on and off by depression.

2. A push switch according to claim 1, wherein an engaging protrusion is formed on a selected one of said latch mount and said magazine, and an engaging hole for engaging said engaging protrusion is formed on the other of said latch mount and said magazine.

3. A push switch according to claim 1, wherein an engaging slot is formed on a selected one of said key-top and said body, and an engaging protrusion for engaging said engaging slot to restrict a return motion of the key-top is formed on the other one of said key-top and said body.

* * * * *